United States Patent [19]

Bates et al.

[11] 4,359,901

[45] Nov. 23, 1982

[54] METHOD FOR MAKING MEASUREMENTS OF THE CHEMICAL SWELLING EFFECT OF A FLUID ON A SHALE

[75] Inventors: Thomas R. Bates, Missouri City; Richard B. Bonner; Ronald K. Clark, both of Houston, all of Tex.

[73] Assignee: Shell Oil Company, Houston, Tex.

[21] Appl. No.: 223,444

[22] Filed: Jan. 8, 1981

[51] Int. Cl.[3] ..... E21B 49/00

[52] U.S. Cl. ..... 73/153

[58] Field of Search ..... 73/153, 825, 37, 37.5, 73/38, 760; 23/230 EP

[56] References Cited

U.S. PATENT DOCUMENTS 3,018,660 1/1962 Schmid ..... 73/153

3,646,997 3/1972 Chenevert ..... 73/153 X

*Primary Examiner*—Jerry W. Myracle

[57] ABSTRACT

The drilling or treating of subterranean shale-containing earth formations is improved by adjusting the composition of the fluid used to reduce the positive shale swelling strain it causes when a shale sample is first equilibrated with fluid under conditions simulating those in the earth formation and the equilibrating fluid is replaced by the fluid being tested without otherwise significantly altering the conditions of the equilibration.

5 Claims, 8 Drawing Figures

METHOD FOR MAKING MEASUREMENTS OF THE CHEMICAL SWELLING EFFECT OF A FLUID ON A SHALE

BACKGROUND OF THE INVENTION

The invention relates to contacting shaley subterranean earth formations with drilling or treating fluids which might cause borehole instability problems. More particularly, the invention relates to identifying and quantifying the chemical swelling effect of a fluid on a shale-containing subterranean earth formation.

A recently filed patent (U.S. Pat. No. 4,142,595, filed Feb. 13, 1978) on a drilling fluid containing flax seed gum and potassium or ammonium salts, says, "Drilling of shale is a very old problem. One view of U.S. patent literature indicates that about 800 different substances have been disclosed for drilling shales in the patents issuing prior to 1954" (column 1, lines 14 to 17). The Principles of Drilling Mud Control, 12th edition, edited by a subcommittee of the API Southern District Study Committee on drilling fluids and published by Petroleum Extension Service, 1969, discusses the problems of drilling into shales (on pages 43 to 48) and indicates that . . . "Maintaining hole stability when drilling shale sections can be troublesome. No simple solution exists, but good drilling practices combined with good mud practices are helpful." In discussing good mud practices, it is stated that . . . "An ideal fluid would be one that does not alter the shales adversely, for once a problem has been created it is difficult to stop . . . "

U.S. Pat. No. 3,646,997 describes a procedure for determining compatibility of a well fluid with a subterranean shale by determining the direction and extent of water migration (due to adsorption or desorption within the shale) between the well fluid and the shale. With respect to such a procedure, the patent indicates that . . . "Laboratory tests performed at reservoir conditions of temperature and pressure when compared with adsorption tests conducted under atmospheric conditions, indicate that atmospheric tests are sufficiently accurate for most practical purposes." (column 5, lines 64–68).

SUMMARY OF THE INVENTION

The present invention relates to measuring the chemical swelling effect of a fluid on a shale-containing subterranean earth formation. A portion of shale from the earth formation is contacted with a fluid which is, or is substantially equivalent in composition to, the interstitial water contained within the subterranean earth formation. The shale and the fluid are at least substantially equilibrated at a confining pressure and fluid pressure at least substantially equalling those within the subterranean earth formation. The shale is similarly contacted with the fluid to be tested under substantially the same conditions and measurements are made of the resultant differences in the swelling strains within the shale.

DESCRIPTION OF THE INVENTION

Applicants have now discovered that the total swelling strain which occurs when a sample of a shale under a confining pressure is contacted with an aqueous liquid is composed of distinctive effects each of which have a significant magnitude. The first is a poroelastic strain, i.e., a mechanical strain which corresponds to the effective stress law. The second is a chemically induced swelling strain which is produced by adsorption of water.

Where a shale sample is contacted with an aqueous liquid having a composition substantially equivalent to the water present in the subterranean shale and the confining pressure on the so-contacted shale and the pore pressure on the shale-contacting liquid are consistent with, or substantially equivalent to, those existing in the location at which the shale occurred within the earth, the changes which occur in the strains within the shale are due to a return to insitu conditions—rather than to a chemically induced swelling response to that particular fluid. Because of this, the true or chemically induced swelling response to a particular fluid can and should be measured selectively, after at least a substantial equilibration of the shale with a shale contacting fluid which is, or is substantially equivalent to, the interstitial water which is present in the subterranean shale deposit from which the shale was obtained.

Such a selective measurement is valuable. It indicates whether a given shale problem is due to mechanical factors, which can be corrected without a necessary change in the active chemical composition of drilling or treating fluid—or whether the problem is due to chemical factors, which can only be corrected by a chemical change in the fluid being used.

Figure 1:
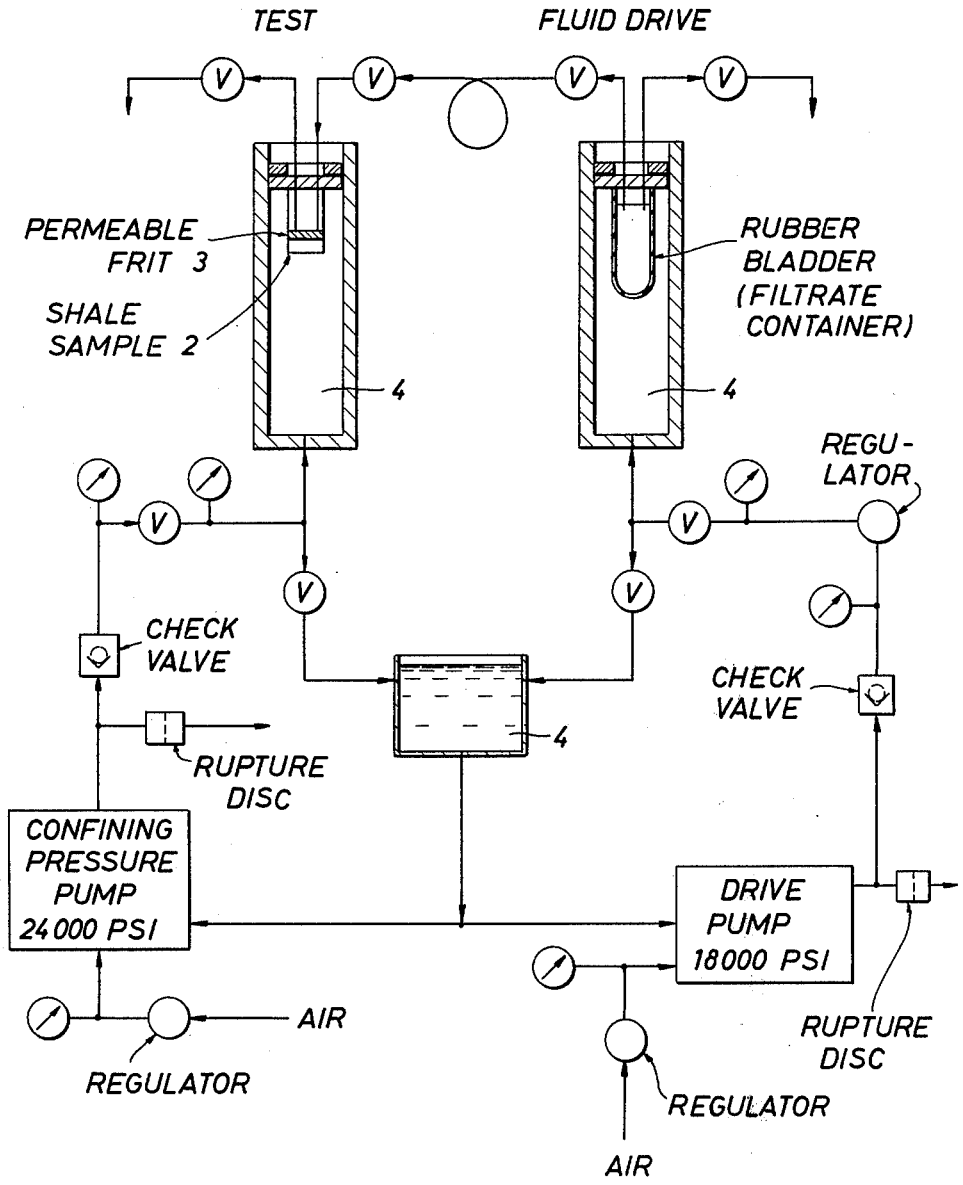
FIG. 1 shows an apparatus suitable for use in the present process.
Figure 2A:
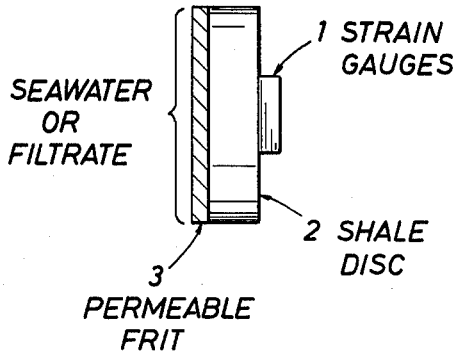
FIGS. 2A and 2B show details of the shale and strain gauges in configuration on the device of FIG. 1.
Figure 2B:
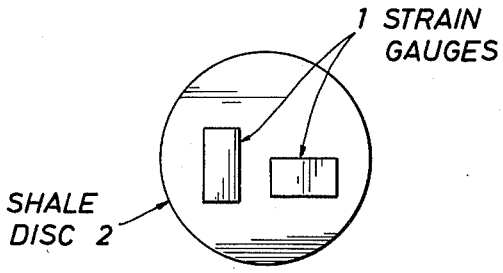

FIG. 1 schematically illustrates an apparatus for practicing the present invention. Strain gauges 1 are mounted on the lower or back face of a disc-shaped sample of shale 2 (see FIGS. 2A and 2B). The opposite face of the sample is placed against a permeable and substantially pressure-resistant solid, such as a frit 3. The assembly of the sample, strain gauges and permeable solid or frit is encased within a flexible, fluid-impermeable sheath, such as a coating of wax (not shown) and immersed in a liquid 4 which can be pressurized to provide a selected confining pressure.

That assembly and associated means for pressurizing the confining and pore-contacting liquid provide a means for contacting the shale with a shale-contacting fluid, or pore fluid which is, or is equivalent to the interstitial water present in the subterranean formation from which the shale was obtained. The shale and the shale-containing fluid are preferably subjected to a confining pressure and a pore fluid pressure at least substantially equaling those within the location from which the shale was obtained. As will be apparent to those skilled in the art, such contact and confinement can readily be effected by means of an arrangement of conventional fluid handling devices such as that shown.

The swelling strains within the so-contacted and confined shale are preferably allowed to at least substantially come to equilibrium. Then, preferably without inducing any significant change in the other conditions, fluid is flowed through the permeable frit so that the initially used shale-contacting fluid is replaced by the fluid to be tested. The permeable frit, through which fluid can be flowed or kept static in contact with the shale, provides a means for replacing the shale-contacting fluid with a fluid to be tested while maintaining substantially the same pore pressure and confining pressure. Determinations are made of the change with time in the swelling strains within the shale sample.

The shale sample can comprise cores obtained from a subterranean shaley earth formation by means of coring techniques and equipment such as those which are currently available. Additionally, or alternatively, the shale samples can be made by bit cutting compaction procedures such as those described in the Journal of Petroleum Technology, July, 1969, pages 883–892. In such a procedure, compacted specimens are preferably formed from drill cuttings which have been washed free of drilling fluid, dried and ground to pass through a 20 mesh screen. The ground cuttings are then moistened with a fluid which is, or is substantially equivalent to the interstitial content in the subterranean shale formation and compacted at an effective stress of about 8500 psi for about 24 hours. The disc-shaped samples to be used can be cut from the so-compacted specimens by techniques and equipment such as those which are presently available.

The fluids to be tested can comprise substantially any which are sufficiently free of solid particles to flow through a suitable permeable structure, such as a frit, for providing a relatively free flow of fluid while mechanically supporting a shale sample which is compressed against one side of the structure by a confining pressure simulating the confining pressure within the shale deposit from which the sample was obtained. Such fluids can advantageously be the aqueous liquid phase of a water-based drilling or completion fluid, or a water-containing oil-based drilling or completion fluid such as an invert emulsion mud, or a similar component of a well treating fluid or a fluid used for displacing a well treating fluid through a borehole of a well, etc.

Figure 3:
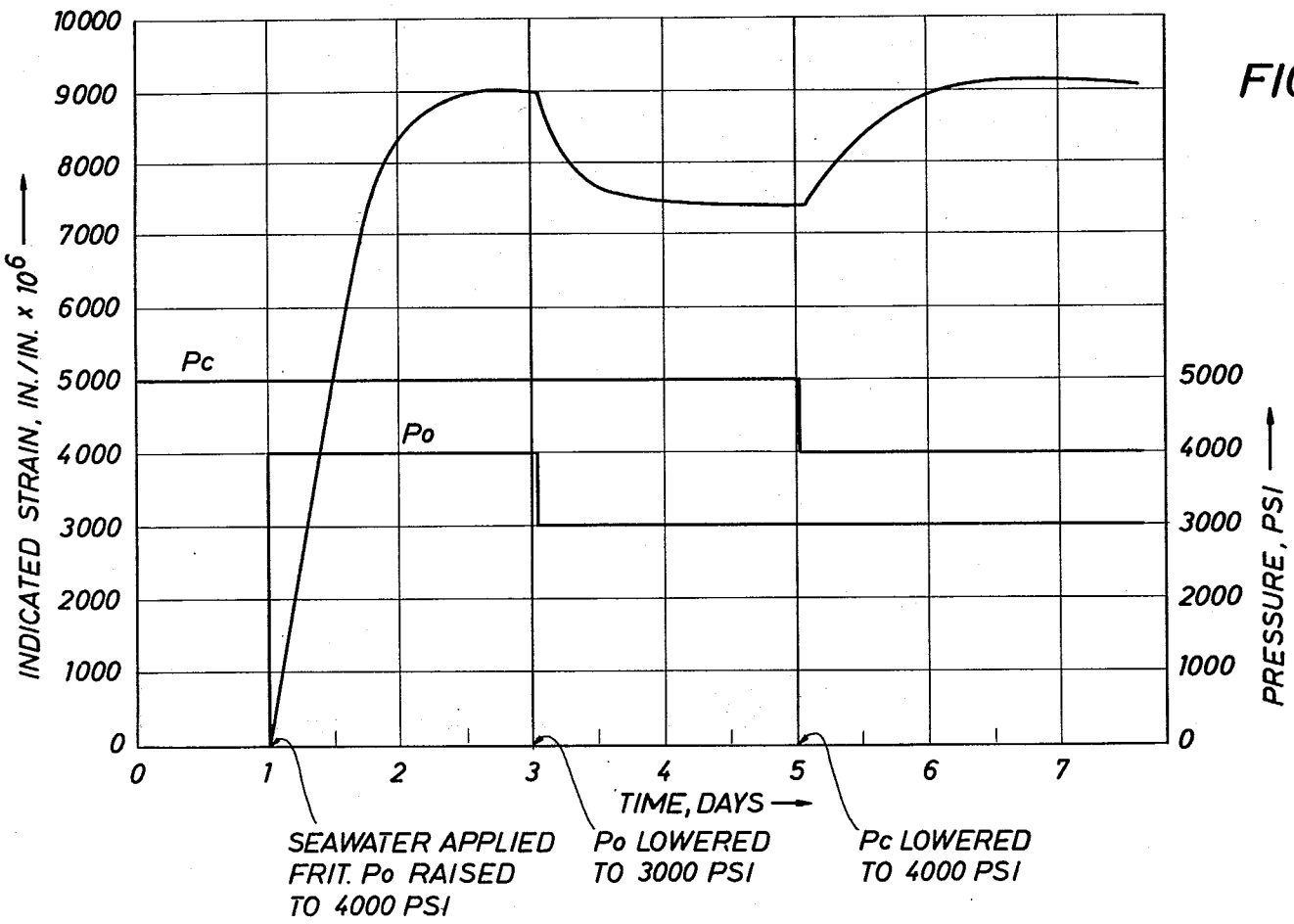
FIG. 3 shows the changes in the strains within a shale sample due to changes in, respectively, the confining pressure and the pore pressure.

FIG. 3 shows the effects of changing, respectively, the pore pressure and the confining pressure in and around a shale sample which is contacted by a synthetic sea water, such as ASTM D1141-52, Table 1, Section 4, Formula, Standard Specification For Substitute Ocean Water. FIG. 3 shows that the response to changes in pore pressure and confining pressure are nearly identical and are strongly time dependent; because of the low permeability of the shale. Based on equilibrium responses (with about 48 hours being characteristic for the times required to reach substantial equilibrium) it is believed to be apparent that the presence or absence of a pore pressure substantially equaling that in the subterranean formation of interest is indeed significant and must be considered in establishing the deformation behavior of a shale.

Figure 4:
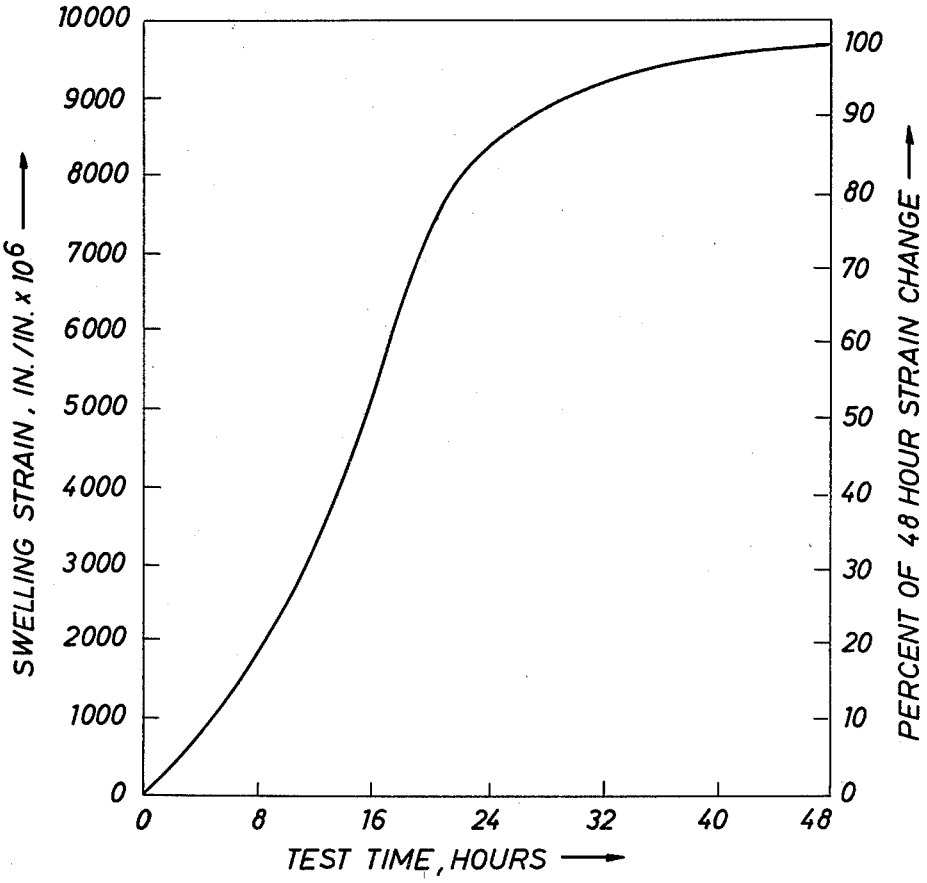
FIG. 4 shows the changes in strain with time during the contacting of a shale sample with a synthetic sea water.

FIG. 4 shows a plot of a typical total swelling strain curve which is produced when the above-described synthetic sea water is displaced through and kept static within a permeable frit to provide a pore fluid pressure of about 4000 psi of fluid in contact with a shale sample subjected to a confining pressure of about 5000 psi. The illustrated curve is typical for a Pierre shale during the first 48 hours of exposure to such a pore fluid. The substantially equilibrated swelling strain ranged from 8250 to 11500 microstrain units with an average near 9700 microstrain. Further increases after 48 hours were relatively modest amounting to an additional 2 to 6% over the 48 hour value. Because of this, it is generally suitable to use the initial 48-hour equilibration point as a reference and compare subsequent strain changes to that reference. When normalized, with the 48-hour point as 100%, substantially all initial swelling curves fall within a narrow band around the curve shown in FIG. 4.

Figure 5:
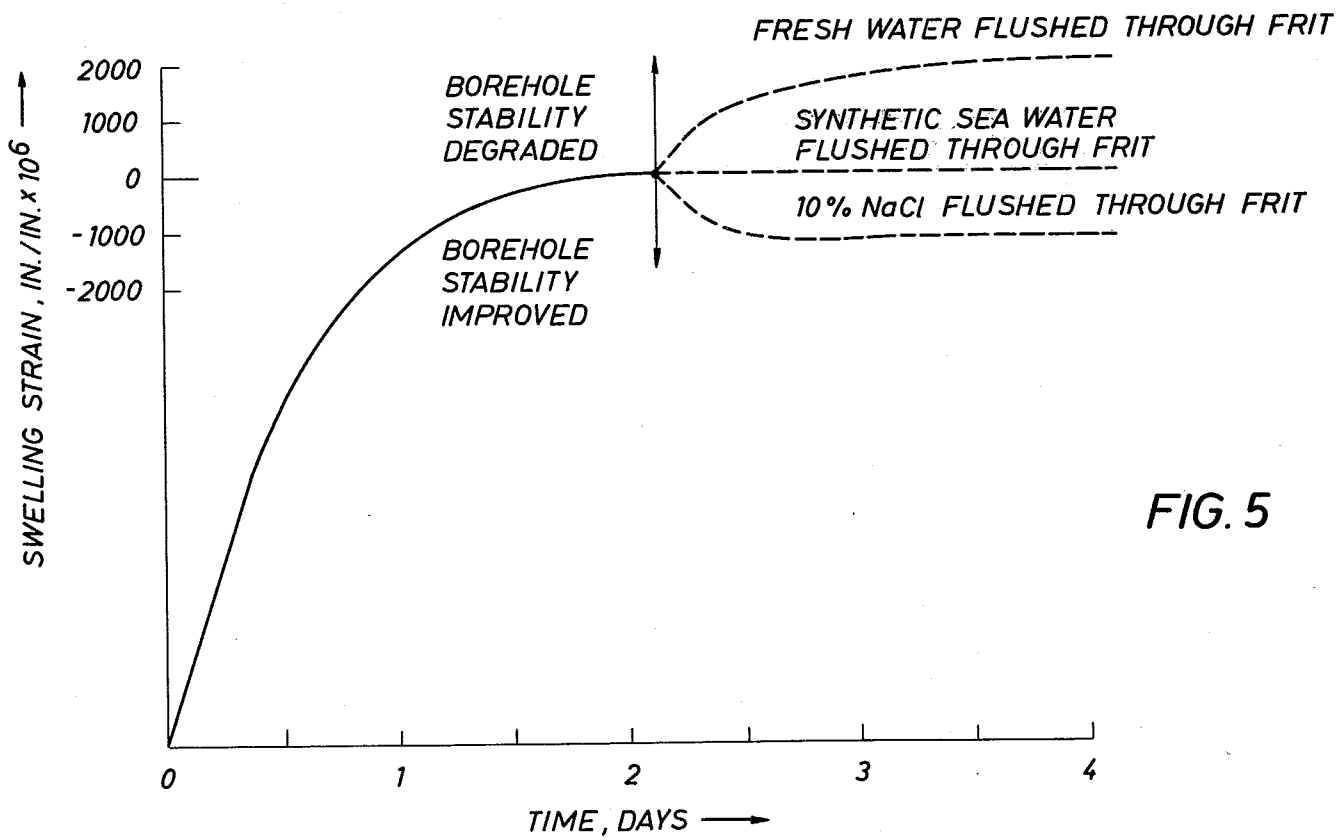
FIG. 5 shows the changes in strains with time when a shale sample, equilibrated with synthetic sea water at conditions similar to those in the subterranean deposit, is contacted, at the same conditions, with fresh water and with 10% sodium chloride.

FIG. 5 shows a plot of swelling strains with the zero strain point defined as the substantially equilibrated strain when the core is in contact with a fluid at least substantially equivalent to the natural pore fluid such as the synthetic sea water described above) at a pore pressure and confining pressure at least substantially equivalent to those within the subterranean shale-containing formation. Tests with, respectively, fresh water, and an aqueous solution of 10% by weight sodium chloride, were conducted by flowing those fluids through the frit (at substantially the same pore pressure) and periodically flushing the frit with the same fluids (after an equilibrium had been substantially reached with the synthetic sea water). The swelling responses indicate that the 10% sodium chloride solution is an inhibitive fluid which causes the swelling strains to be negative—while fresh water is destabilizing fluid which promotes borehole instability by causing the swelling strains to be positive.

Figure 6:
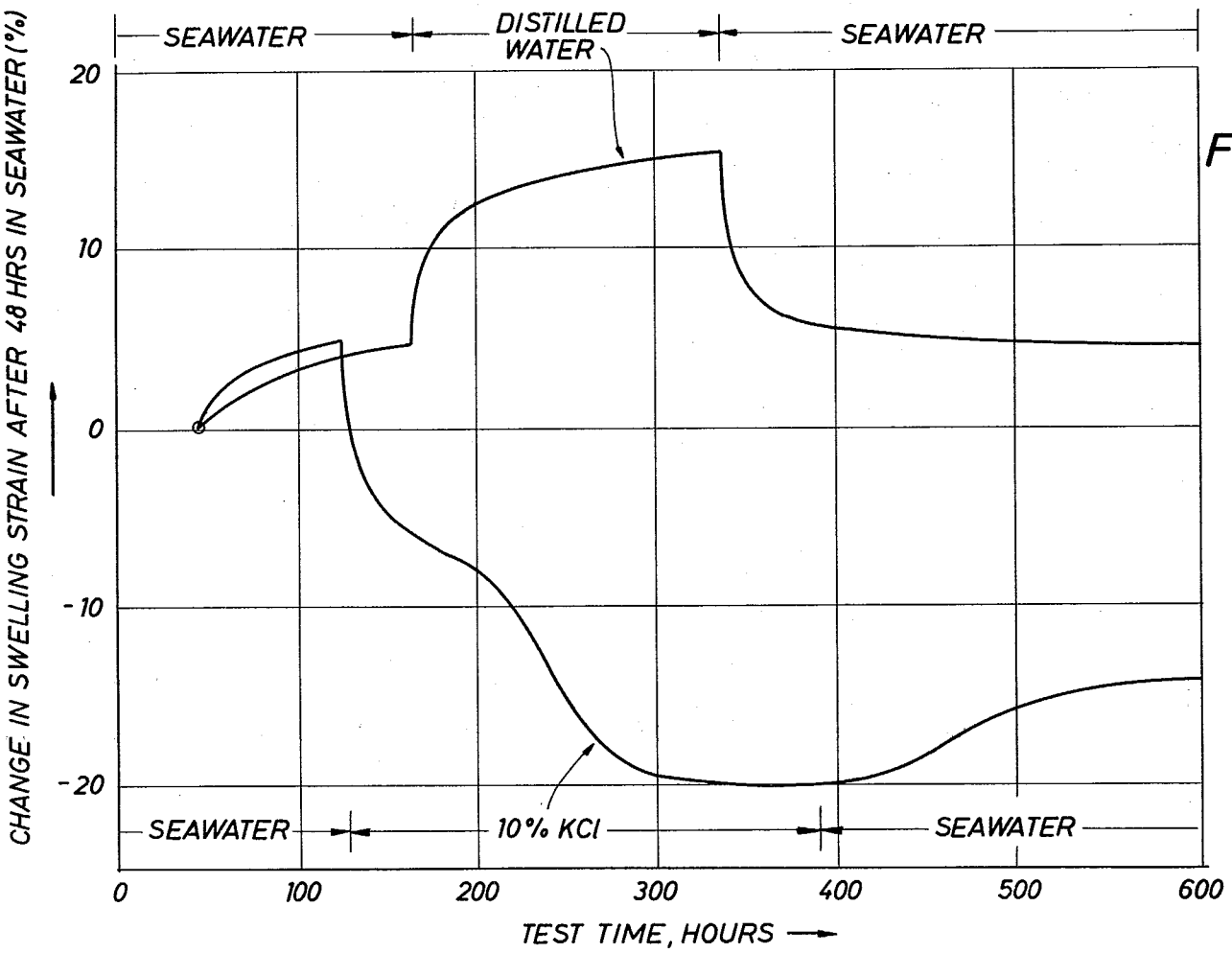
FIG. 6 shows a plot of the chemically induced shale swelling due to contact with, respectively, distilled water and 10% potassium chloride each followed by sea water.

FIG. 6 shows the results of typical tests for determining whether the swelling response to a test fluid can be reversed by reexposure to sea water. As indicated by the upper curve, an exposure to distilled water for about 170 hours resulted in a net positive swelling strain of about 10.4%. A subsequent exposure to sea water produced a negative swelling strain of nearly equal magnitude (about a minus 10.1%) and thus a swelling due to distilled water is reversible.

On the other hand, as indicated in the lower curve, the contacting of the sample with a water solution containing 10% by weight potassium chloride produced a negative swelling strain (of a minus 24.5%) which was only slowly and partially reversed by a subsequent contact with sea water.

Figure 7:
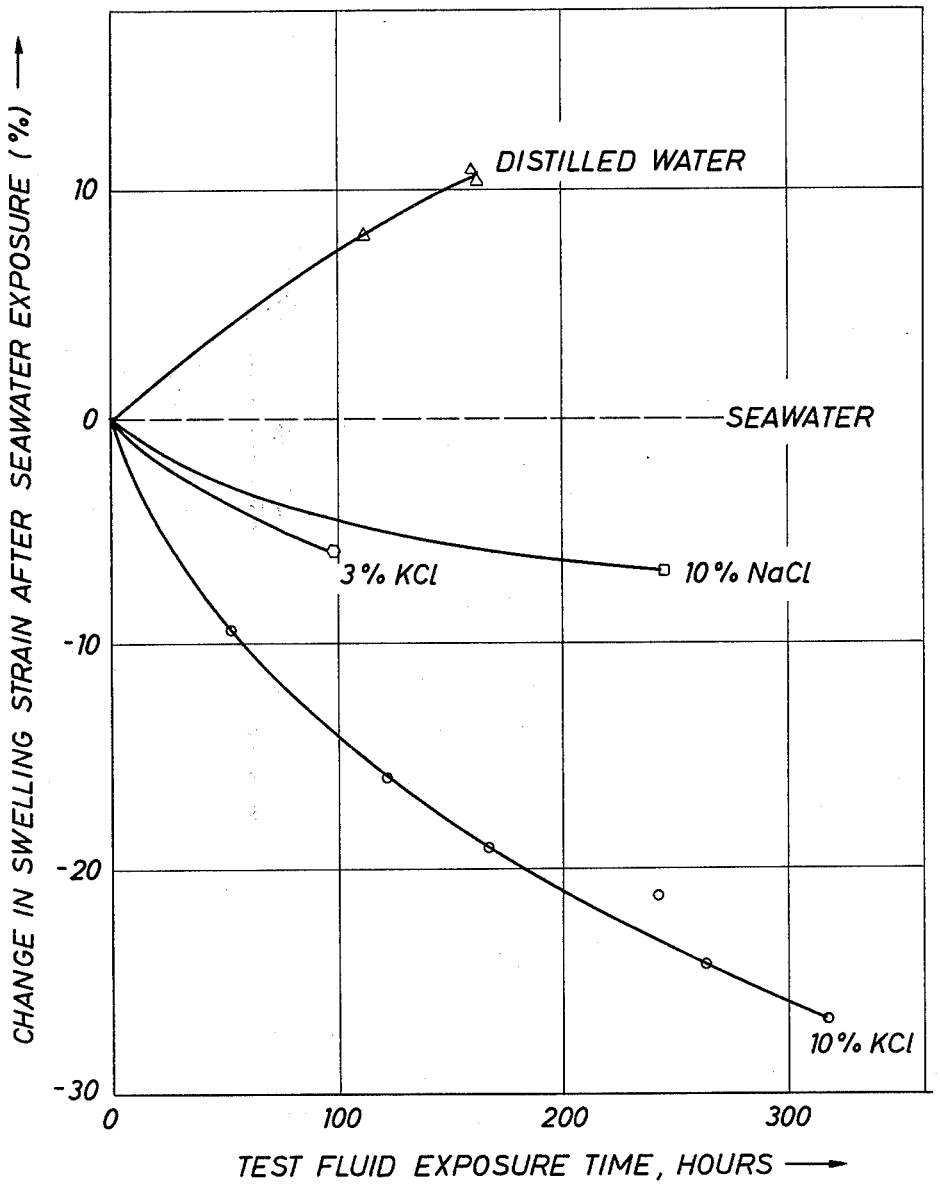
FIG. 7 shows a plot of the chemically induced shale swelling strain due to contact with distilled water and various salt solutions.

FIG. 7 shows the results of similarly contacting a Pierre shale which had been previously equilibrated with the synthetic sea water described above with various aqueous liquids. As indicated, distilled water continued to produce a relatively high rate of positive swelling throughout an exposure time of nearly 200 hours. The swelling responses to water solutions of 3% potassium chloride and 10% sodium chloride are both negative and are of similar magnitude. An aqueous 10% potassium chloride solution produced the largest negative swelling response, with a magnitude some 20% or more below the sea water equilibration level.

The present invention is particularly useful in optimizing the drilling fluid to be used in a development drilling program. As known to those skilled in the art, although the onset of a shale drilling problem is readily recognizable, it is often difficult to determine whether that problem is due to chemical or mechanical factors. This can be determined by the present invention. Bit cuttings can be obtained from the formation being drilled at the time the shale problem was encountered. A reconstituted shale sample made from those cuttings can be equilibrated with a pore fluid providing a combination of pore pressure and confining pressure, substantially duplicating the conditions existing in the formation then being drilled. And, if the replacing of that pore fluid with the aqueous liquid phase of the drilling fluid fails to cause a significant positive swelling effect on the shale, it is indicated that the shale problem was due to mechanical defects. In such a situation, with adequate avoidance of factors conducive to mechanically induced failures, it is likely that a drilling fluid whose active chemical composition is the same or substantially equivalent to the one tested can advantageously be used in further operations in the same field.

On the other hand, if the tests indicate that the drilling fluid did cause a significant positive chemically induced swelling effect, the effects of alternative fluids or modifications of that fluid can readily be determined. Such tests can advantageously be used to select a fluid which causes relatively little or no positive chemically induced swelling effect. The present invention can similarly be used for adjusting the composition of a well treating or well treating fluid-displacing liquid for use in a borehole which encounters a shaley subterranean earth formation. Where the amount of the shale sample is limited, fluids containing potassium salts should be tested last to avoid an irreversible modification of the sample.

What is claimed is:

1. A process for measuring a chemical swelling effect of a fluid on a sample of a shale-containing subterranean earth formation, comprising:

contacting a sample of shale obtained from said earth formation with a fluid which is, or is substantially equivalent to, the interstitial water contained in said earth formation;

at least substantially equilibrating the so-contacted shale at pressures at least substantially equivalent to those existing in said earth formation;

contacting the shale with the fluid to be tested at substantially the pressures used in said equilibration; and detecting any resultant positive or negative change in the shale swelling strain that was exhibited during said equilibration.

2. The process of claim 1 in which said measurements are used after once drilling into said earth formation for selecting the composition of an aqueous liquid component of a drilling fluid for drilling an additional well into said earth formation, by:

obtaining said sample of shale from bit cuttings recovered during the drilling of said earth formation by compacting the bit cuttings into a reconstituted shale sample;

using the aqueous liquid which may be used as a liquid component of a drilling fluid as the fluid to be tested; and, adjusting the composition of the aqueous liquid component of the drilling fluid used which is selected for drilling at least one additional well into said earth formation to the extent required to provide one which keeps a resultant change in shale swelling strain within a selected range.

3. The process of claim 1 in which said measurements are used for adjusting the composition of an aqueous liquid component of a well treating fluid to be used in contact with said formation, by:

using said well treating fluid component as said fluid to be tested; and, adjusting the composition of said well treating fluid component to the extent required to keep any resultant change in shale swelling strain within a selected range.

4. A process for determining whether, and to what extent, an apparent borehole instability within a subterranean shale-containing earth formation is due to a chemically induced swelling, comprising:

contacting a portion of shale obtained from said earth formation with a fluid which is, or is substantially equivalent to, the interstitial water contained within said earth formation;

at least substantially equilibrating the so contacted shale at pressure conditions at least substantially equivalent to those existing in said earth formation;

contacting said shale with a substantially solids-free sample of the fluid with which said earth formation was being contacted when said borehole instability became apparent at substantially the same pressure conditions at which said shale was equilibrated; and, detecting whether a significant extent of resultant positive change in the shale swelling strain was exhibited during said contacting of the shale with said fluid sample.

5. A process for measuring the chemical swelling effect of a fluid on a shale obtained from a subterranean earth formation comprising:

contacting the shale with a fluid that is or is substantially equivalent to the interstitial water contained in said subterranean formation while said shale and fluid are subjected to a pore pressure and a confining pressure at least substantially equalling those within said subterranean formation;

replacing the shale-contacting fluid with the fluid to be tested without significantly altering any other conditions of said equilibration; and, detecting any resultant change in the shale swelling strain which existed during said equilibration.

* * * * *